United States Patent [19]

Scott et al.

[11] 4,318,734

[45] Mar. 9, 1982

[54] REDUCTION OF IRON OXIDE UTILIZING DEHYDRATING AGENT

[75] Inventors: Lawrence M. Scott, Newark; Irving Wolf, Los Altos; Yu C. Lee, Newark, all of Calif.

[73] Assignee: Ampex Corporation, Redwood City, Calif.

[21] Appl. No.: 124,197

[22] Filed: Feb. 25, 1980

[51] Int. Cl.[3] ..... B22F 9/00

[52] U.S. Cl. ..... 75/0.5 BA; 75/34

[58] Field of Search ..... 75/0.5 BA, 33–37, 75/0.5 B; 34/9; 148/105; 252/184

[56] References Cited

U.S. PATENT DOCUMENTS

| | | | |
|---|---|---|---|
| 2,879,154 | 3/1959 | Campbell | 74/0.5 BA |
| 3,607,219 | 9/1971 | Giessen et al. | 75/0.5 BA |
| 4,050,962 | 9/1977 | Koester et al. | 75/0.5 BA |

FOREIGN PATENT DOCUMENTS

| | | | |
|---|---|---|---|
| 438692 | 1/1975 | U.S.S.R. | 75/5 |

*Primary Examiner*—Michael L. Lewis

*Attorney, Agent, or Firm*—Robert G. Slick; Joel D. Talcott

[57] ABSTRACT

Highly orientable acicular iron particles are made by reducing an acicular ferric oxide in powder form by contacting the granular acicular ferric oxide with hydrogen in the presence of a dehydrating agent selected from calcium hydride, calcium, calcium carbide, and mixtures thereof.

6 Claims, No Drawings

REDUCTION OF IRON OXIDE UTILIZING DEHYDRATING AGENT

SUMMARY OF THE INVENTION

The magnetic particles used in making magnetic recording elements, such as magnetic tapes, generally consist of acicular γ-ferric oxide. Although it has long been recognized that iron itself would be superior to γ-ferric oxide with respect to signal-to-noise ratio, magnetic moment and coercive force, there are certain practical difficulties which prevented an extensive use of metallic iron particles for recording purposes.

One disadvantage is that the usual reduction processes, either gaseous or chemical, frequently destroy the desired acicular shape and thus result in particles which are difficult to disperse and orient. Frequently, particularly when using gaseous reduction methods, a metallic alloy pigment results which does not lend itself to being magnetically oriented. Presumably, this is the result of sintering and destruction of the desired acicular shape.

One difficulty which is always encountered in a gaseous reduction process is that the byproduct of the desired reaction is water. Thus, a large amount of the hydrogen is used up in making water and also the water prevents the reaction from going to completion so that in the absence of the dehydrating agent the reaction time becomes impractical. Thus even with very high hydrogen flow rates the reaction does not go to completion, and of course, hydrogen is an expensive reactant. Further it is necessary to operate at such a high temperature that a substantial amount of sintering takes place.

In accordance with the present invention, it has been found that by using an optimum ratio of selected dehydrating agents that the reaction time can be cut down, the temperature can be reduced and the quantity of hydrogen necessary can also be reduced. Thus, the reaction becomes practical from an economic standpoint.

Further, as the data will subsequently show, not only is the reaction time and temperature lowered but also the results obtained are much better so that the resulting iron particles have a high coercivity and squareness. In fact, the coercivity and squareness are almost twice the values obtained without the use of the desiccant. Fortunately, these valuable changes in property carry over to the finished product so that magnetic tapes made with the metal particles of the present invention have much better properties than tapes made with metal particles not reduced in the presence of a desiccant.

The starting materials can be either red or yellow acicular ferric oxide or acicular γ-ferric oxide, and these are reduced to metallic iron in a stream of hydrogen gas in the presence of a desiccant. Preferably this is conducted at a relatively low temperature to prevent sintering and to preserve the acicular particle shape. Normally, the temperature must not be over 450° C. and preferably is not over 350° C. There is no lower limit as to the temperature except that the temperature must be high enough to make the reaction go fast enough to be economically feasible. Normally the minimum practical temperature of the conversion is about 275° C.

As desiccants, calcium hydride, calcium carbide, metal calcium or mixtures thereof can be used. The preferred desiccant is calcium metal and other suitable desiccants are mixtures of calcium hydride and calcium metal. The amount of the desiccant is not critical and can be as low as 0.65:1 to 3:1 or even higher, based on the weight of the oxide.

Although pure calcium metal is the preferred desiccant because of its low cost and effectiveness, the reaction between the dehydrating agent and the water is an extothermic reaction, and also there is a tendency for calcium to react with the iron oxide, interfering with the desired reaction. It has been found that by using a mixture of calcium and calcium hydride or calcium carbide the reaction is conducted at a much lower cost with less hazard and with less tendency for undesired side reactions.

DESCRIPTION OF THE PREFERRED EMBODIMENTS

In the following non-limiting examples comparisons are made between the reduction reactions run with and without a desiccant.

EXAMPLE 1

(Prior art) 2.5 Kg of γ-ferric oxide was reduced at 330° C. with hydrogen, flow rate 175 CFH, for 41 hours. The material was then cooled to ambient conditions and stablized by carefully bleeding air into the reactor, thus applying an oxide coating around each particle. The resulting material was discharged and its powder and magnetic properties determined, both as to the particles per se and magnetic tapes made from the particles.

EXAMPLE 2

2.5 Kg of γ-ferric oxide was mixed with 5.0 Kg of $CaH_2$. The oxide was then reduced at a temperature of 330° C. for 48 hours with a hydrogen flow rate of 10 CFH. After reduction, the material was cooled, stablized and evaluated as in Example 1.

EXAMPLE 3

2.5 Kg of γ-ferric oxide was mixed with 4.2 Kg of calcium. The oxide was then reduced at 345° C. with hydrogen, flow rate 10 CFH, for 52 hours. The resulting product was cooled, stablized and evaluated as in Example 1.

EXAMPLE 4

2.5 Kg of γ-ferric oxide was mixed with 4.2 Kg of calcium. This material was reduced at 330° C. with hydrogen, flow rate 10 CFH, for 79 hours. The resulting product was cooled, stablized and evaluated as in Example 1.

EXAMPLE 5

2.5 Kg of γ-ferric oxide was mixed with 3.15 Kg of calcium and 1.05 Kg of calcium hydride. The oxide was reduced at 345° C. using hydrogen gas, flow rate 10 CFH, for 50 hours. The resulting product was cooled, stablized and evaluated as in Example 1.

EXAMPLE 6

2.5 Kg of γ-ferric oxide was mixed with 4.0 Kg of calcium. This material was reduced at 345° C. with hydrogen, flow rate 10 CFH, for 72 hours. The resulting product was cooled, stablized and evaluated as in Example 1.

EXAMPLE 7

2.5 Kg of γ-ferric oxide was mixed with 3.15 Kg of calcium and 1.05 Kg of calcium carbide. The oxide was reduced at 330° C. with hydrogen, flow rate 10 CFH, for 72 hours. The resulting product was cooled, stablized and evaluated as in Example 1.

The magnetic properties of the metallic iron particles made in accordance with the foregoing examples were measured and also samples of the various iron particles were combined with a resin binder and used to make a magnetic tape. The properties of the tape were measured. Thus, the following results were obtained, both on the iron particles as made in accordance with the foregoing examples and also with practical magnetic tapes fabricated and utilizing these particles.

MAGNETIC RESULTS

| Example No. | Desiccant/ Reductant (Weight Ratio) | *Powder Properties Hc(oe) | σS (Emu/g) | Square-ness (Br/Bs) | **Tape Properties Hc(oe) | Square-ness |
|---|---|---|---|---|---|---|
| 1 | None | 610 | 117 | 0.42 | 560 | 0.72 |
| 2 | $CaH_2$ | 992 | 133 | 0.46 | 927 | 0.81 |
| 3 | Ca | 1089 | 131 | 0.47 | 1045 | 0.76 |
| 4 | Ca | 1127 | 139 | 0.46 | 1092 | 0.83 |
| 5 | $CaH_2$/Ca ($\frac{1}{3}$) | 971 | 126 | 0.45 | 920 | 0.80 |
| 6 | Ca | 1156 | 139 | 0.49 | 1211 | 0.78 |
| 7 | Ca/$CaC_2$ (3/1) | 1010 | 138 | 0.47 | 939 | 0.79 |

*$H_{app}$: 8Koe D.C.
**$H_{app}$: 5Koe D.C.

We claim:

1. A process of reducing an acicular iron oxide to produce acicular metal particles suitable for magnetic recording comprising:

a. producing a mixture by mixing particles of an acicular iron oxide with a desiccant selected from calcium, mixtures of calcium hydride with calcium and calcium carbide with calcium;

b. subjecting said mixture to a stream of hydrogen at an elevated temperature until at least some of said oxide is reduced to metallic iron and;

c. cooling said mixture and separating said iron from said desiccant.

2. The process of claim 1 wherein the desiccant is calcium.

3. The process of claim 1 wherein the desiccant is a mixture of calcium hydride and calcium.

4. The process of claim 1 wherein the desiccant is a mixture of calcium carbide and calcium.

5. The process of claim 1 wherein the starting iron oxide is γ ferric oxide.

6. The process of claim 1 wherein the temperature is from about 275° C. to 450° C.

* * * * *